US009472883B2

(12) United States Patent
Honnige et al.

(10) Patent No.: US 9,472,883 B2
(45) Date of Patent: Oct. 18, 2016

(54) PLUG CONNECTOR WITH CONTACT DETENT MEANS

(71) Applicant: Amphenol Tuchel Electronics GmbH, Heilbronn (DE)

(72) Inventors: Jens Honnige, Heilbronn (DE); Michael Grimm, Mosbach (DE)

(73) Assignee: Amphenol-Tuchel Electronics GMBH (DE)

( * ) Notice: Subject to any disclaimer, the term of this patent is extended or adjusted under 35 U.S.C. 154(b) by 0 days.

(21) Appl. No.: 14/380,449

(22) PCT Filed: Apr. 6, 2013

(86) PCT No.: PCT/EP2013/001022
§ 371 (c)(1),
(2) Date: Aug. 22, 2014

(87) PCT Pub. No.: WO2013/152843
PCT Pub. Date: Oct. 17, 2013

(65) Prior Publication Data

US 2015/0050845 A1 Feb. 19, 2015

(30) Foreign Application Priority Data

Apr. 13, 2012 (DE) ..... 10 2012 007 481

(51) Int. Cl.

| | |
|---|---|
| ***H01R 13/502*** | (2006.01) |
| ***H01R 13/426*** | (2006.01) |
| ***H01R 13/42*** | (2006.01) |
| ***H01R 13/641*** | (2006.01) |
| *H01R 13/436* | (2006.01) |

(52) U.S. Cl.
CPC ..... *H01R 13/426* (2013.01); *H01R 13/42* (2013.01); *H01R 13/641* (2013.01); *H01R 13/4361* (2013.01)

(58) Field of Classification Search
CPC .. H01R 13/426; H01R 13/42; H01R 13/641; H01R 13/4361; H01R 9/03
USPC ..... 439/752, 357, 595, 695
See application file for complete search history.

(56) References Cited

U.S. PATENT DOCUMENTS

| | | | | |
|---|---|---|---|---|
| 5,403,213 | A * | 4/1995 | Inaba et al. | 439/752 |
| 5,624,278 | A * | 4/1997 | Kuroda et al. | 439/675 |
| 5,624,378 | A | 4/1997 | Baldecchi | |
| 6,780,068 | B2 * | 8/2004 | Bartholoma et al. | H01R 13/648 439/752 |

(Continued)

FOREIGN PATENT DOCUMENTS

| | | |
|---|---|---|
| DE | 20 2006 001 672 | 5/2007 |
| DE | 20 2010 009 598 | 10/2010 |

(Continued)

*Primary Examiner* — Tulsidas C Patel
*Assistant Examiner* — Peter G Leigh
(74) *Attorney, Agent, or Firm* — Blank Rome LLP

(57) ABSTRACT

A plug connector that includes a contact support with at least one or more contact chambers for receiving a contact, at least one electrical contact, a lateral opening on each side in the contact support, connected in each case with one of the contact chambers, and a plurality of locking elements. Each of the locking elements can be introduced into one of the openings in a locking manner in such a way that a locking portion of each of the locking elements blocks the contact in the contact chamber, respectively, at a corresponding locking portion. Each of the locking elements has a coding member for engaging the contact support.

17 Claims, 2 Drawing Sheets

(56) References Cited

U.S. PATENT DOCUMENTS

| | | | | |
|---|---|---|---|---|
| 6,821,160 | B2 * | 11/2004 | Fink et al. | 439/701 |
| 7,347,745 | B1 * | 3/2008 | Raudenbush et al. | 439/752 |
| 7,563,134 | B2 * | 7/2009 | Kim, II | 439/578 |
| 7,661,986 | B2 * | 2/2010 | Maesoba et al. | 439/595 |
| 7,762,854 | B1 * | 7/2010 | Peng | 439/752 |
| 8,512,075 | B2 * | 8/2013 | Sakamoto | 439/752 |
| 8,721,374 | B2 * | 5/2014 | Glick et al. | 439/752 |
| 8,727,816 | B2 * | 5/2014 | Takahashi et al. | 439/752 |
| 2004/0038596 | A1 | 2/2004 | Bartholoma et al. | |
| 2005/0106950 | A1 * | 5/2005 | Fink et al. | 439/752 |
| 2006/0052004 | A1 * | 3/2006 | Yamashita | 439/595 |
| 2007/0054543 | A1 * | 3/2007 | Moll et al. | 439/489 |
| 2009/0130902 | A1 * | 5/2009 | Hall et al. | 439/595 |
| 2010/0240244 | A1 * | 9/2010 | Parikh et al. | 439/368 |
| 2011/0059659 | A1 | 3/2011 | Matsumoto et al. | |
| 2012/0112762 | A1 | 5/2012 | Odorfer et al. | |

FOREIGN PATENT DOCUMENTS

| | | | | |
|---|---|---|---|---|
| EP | 0 475 414 | | 3/1992 | |
| EP | 1 703 595 | | 9/2006 | |
| WO | WO 2009064484 | A1 * | 5/2009 | H01R 27/02 |
| WO | WO 2012000597 | A1 * | 1/2012 | |

* cited by examiner

PLUG CONNECTOR WITH CONTACT DETENT MEANS

RELATED APPLICATIONS

This application is a National Phase of PCT/EP2013/001022, filed on Apr. 6, 2013, which claims priority to German Patent Application 10 2012 007 481.6, filed Apr. 13, 2012, all of the disclosures of which are hereby incorporated by reference herein.

FIELD OF THE INVENTION

The present invention relates to a plug connector with contact latching means.

BACKGROUND OF THE INVENTION

In the prior art there are various principles for how contacts of an electrical plug connector are fastened in the contact body or contact support of the plug connector.

A common variant is the engagement of the contacts in a latching manner by means of one or more spring arms that are fastened directly to the contacts and are supported in equivalent corresponding clearances in the contact support or allow themselves to become latched there.

Such contacts are typically fitted once into the contact support and become permanently latched there, i.e. if it were attempted to release the contact from the contact support, the resilient latching arms would be bent or damaged.

Further solutions for releasably latching contacts in the contact support can be found in the prior art, solutions in which special tools are used to allow the contacts to be operated from the outside and arranged re-releasably in the contact support.

However, there is the problem with the plug connectors known from the prior art that, with increasing miniaturization of the plug connectors and the requirement for higher current carrying capacity, proven contact latching principles lead to large structural forms.

In particular, the air gaps and creepage distances for plug connectors must conform to IEC 61984 or IEC 60664-1 and be dimensioned appropriately in accordance with the application area. Under this premise, there are problems on the one hand in maintaining sufficient distance between the contacts but also on the other hand of making plug connectors sufficiently small.

It is therefore intended to prevent metallic contact latching arms or other latching principles of one contact with respect to the other contact from leading to great relative distances between the contacts.

In other words, an object of the present invention is to provide a simpler, more reliable and more favorable locking and latching of contacts in a contact support while maintaining the required air gaps and creepage distances.

The basic concept of the invention is to latch the contacts in the plug connector by means of a locking element, preferably a coded locking element, to be precise in such a way that the coding element can be inserted into the contact support from the outside, into a locking position intended for it, whereby the contact is fixed and latched in its intended mounting position by a locking portion of the locking element.

In an advantageous way, the following forms of design have been preferred here:

- the contacts are preferably provided with a peripheral annular groove, into which the locking means can engage in order to fix the contacts on the contact support;
- the contact support has openings, into which locking elements can be inserted into the contact chamber of the contact support in order to come into connection there, preferably in a positively engaging manner and possibly in a nonpositively engaging manner, with the contact at the previously mentioned peripheral groove;
- also preferably, the openings in the contact support between the contact chambers and the outer shell of the contact support are formed in such a way that the locking elements are held in the openings in a clamping manner;
- with preference, the locking elements have coding lugs or coding ribs, which can engage into corresponding coding grooves on the contact support, in order to ensure that the respectively correct locking element is inserted into the intended opening in the contact support, in order to fix the contact mounted there;
- each locking element can only be pushed completely into the contact support and lock there if the contact is arranged at its intended position in the contact chamber, and so the locking elements also assume the function of ensuring that a correct contact position in the contact support is ensured;
- in a further advantageous configuration, the locking elements allow themselves to be pushed completely into the contact support, and so they finish flush with the surface of the contact support, whereby it is ensured that the plug connector can only be inserted into a corresponding mating connector if the contacts and locking elements have been introduced correctly and completely. This provides a function that ensures that the contacts are held reliably by the locking elements and the locking elements have been inserted in their intended latching position.

DETAILED DESCRIPTION OF THE INVENTION

Figure 1:
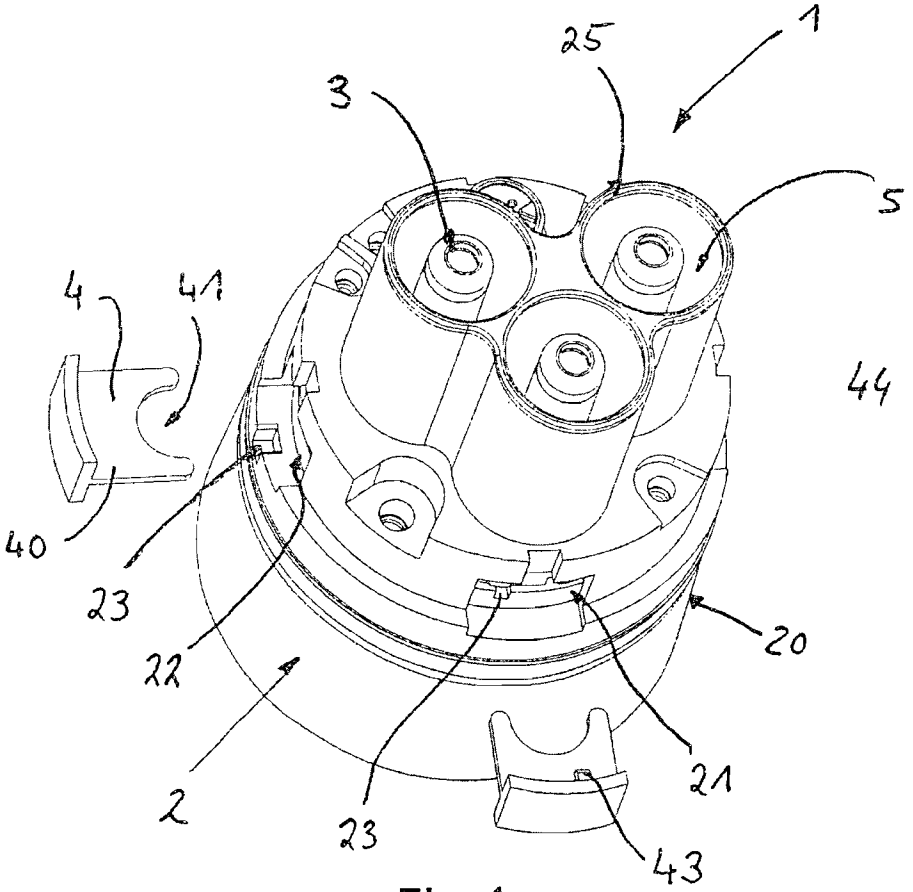
FIG. 1 shows a perspective view of the plug connector according to the invention.

In FIG. 1, an electrical plug connector 1 according to an embodiment of the present invention that is given by way of example is shown.

The plug connector 1 is formed by a contact support 2, formed in which are contact chambers 5, into which contacts 3 have been introduced.

Figure 3:
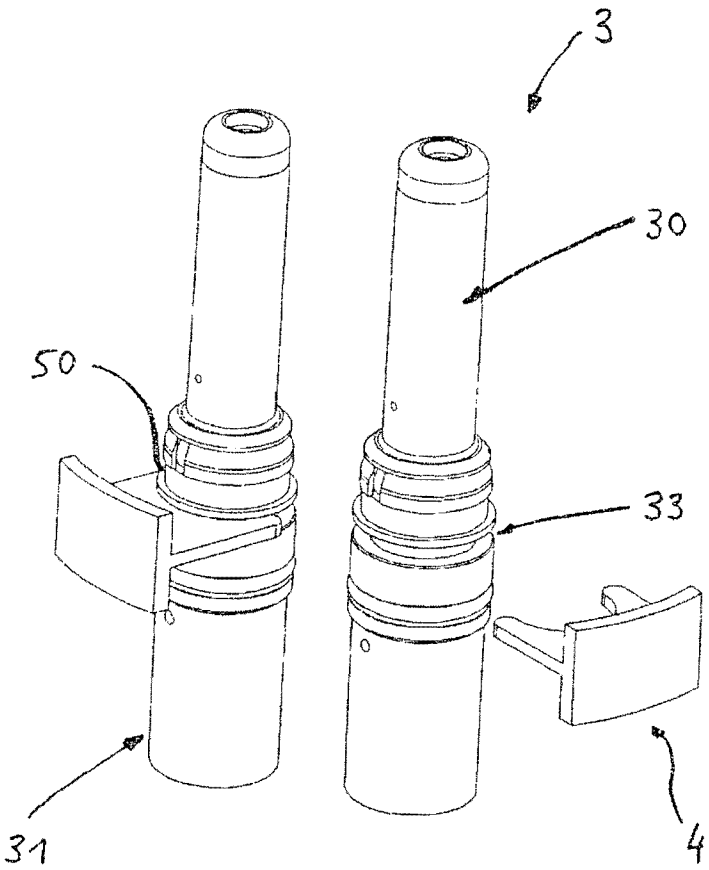
FIG. 3 shows two contact elements or contacts, given by way of example, of the plug connector according to the invention in a perspective view with a locking element arranged in the latching state and a locking element at a distance from said contact element or contact.

The contact support 2 is an insulating body, in which the contact chambers 5 are formed for receiving contacts 3 according to FIG. 3.

The contact support 2 has a contact support outer wall 20 and in the present exemplary embodiment is formed as a substantially cylindrical contact support for a round plug connector.

Figure 2:
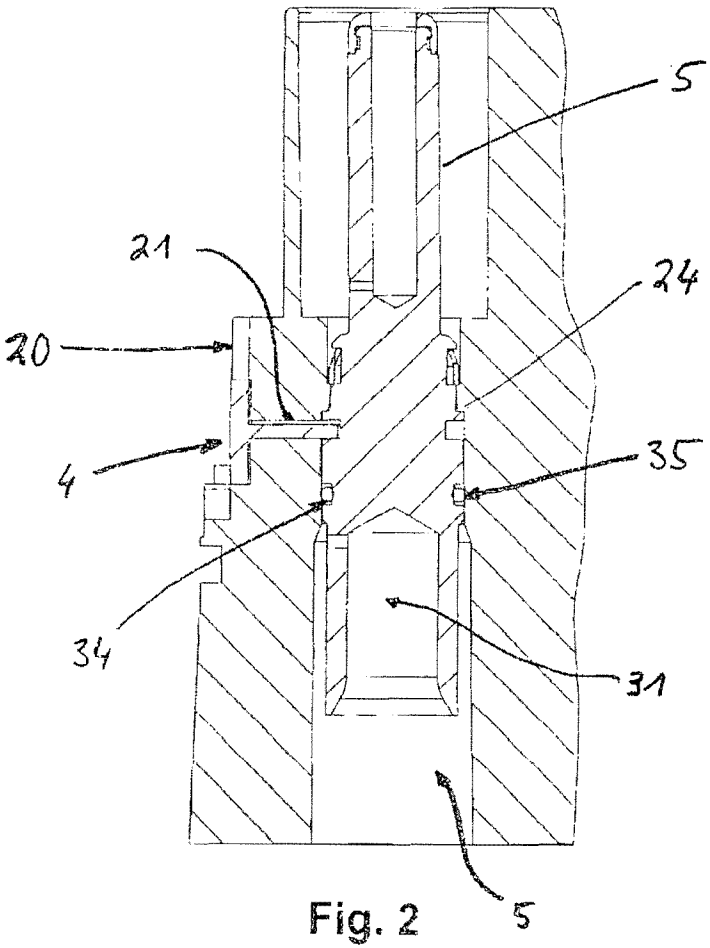
FIG. 2 shows a sectional view through a contact chamber of a plug connector according to the invention similar to the embodiment of FIG. 1.

In the outer wall 20 there are openings 21, which are respectively assigned to a contact chamber 5 and, as can be seen in FIG. 1 and FIG. 2, have been introduced in clearances 22 in the contact support 2 or establish a connection with the contact chamber 5 from the outside.

The clearances 22 are preferably configured as window-like clearances, which have been introduced into the outer casing of the contact support 2 in a sunken manner.

This ensures that, when they are pushed into the contact support 2, to be precise into the openings 21, the locking elements 4 finish flush with the outer wall of the contact support 2, and so there are no troublesome outwardly protruding components.

The contact support 2 has abutting means 24, which interact with mating abutting means 50, to be precise contact abutting means 50 of a contact 3.

A contact 3 can be inserted into the contact support 2 from below in the view according to FIG. 2, to be precise into the contact chamber 5, until the contact abutting means 50 are abutting the corresponding abutting means 24.

As can be clearly seen in FIG. 2 and FIG. 3, in this position a peripheral latching groove 33 of the contact 3 is located in a plane together with the opening 21. The opening 21 is formed as a gap-like opening or a gap-like aperture, in order to push a locking element 4, in the position as described above, into the peripheral latching groove 33 with its plug-side end 42.

Figure 4:
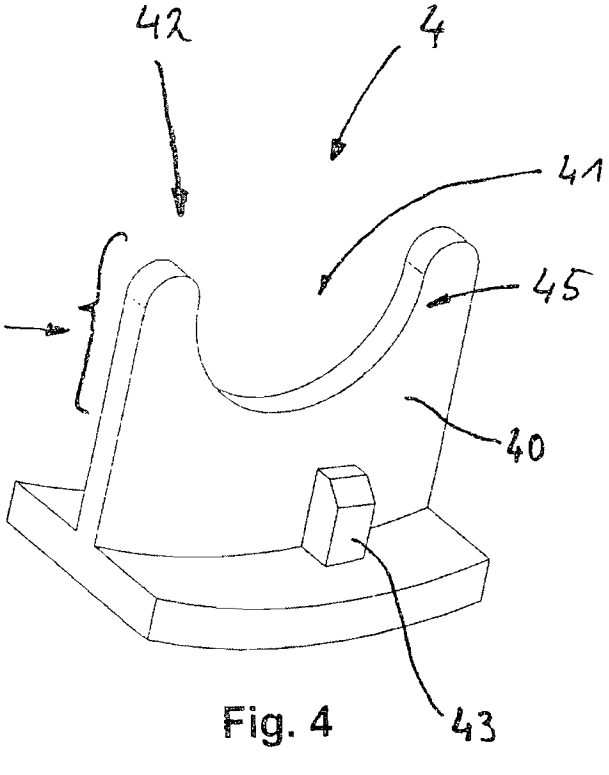
FIG. 4 shows a locking element according to the present invention with a coding rib.

There follows a description of a locking element 4, shown in FIG. 4, which exhibits an embodiment of a locking element 4 according to the invention that is given by way of example.

The locking element 4 has a plate-like portion 40, at the plug-side end 42 of which there is a semicircular clearance 41.

It can also be seen that arranged on the locking element 9 is a coding rib 43, which ensures that the locking element 4 can only be inserted into its intended opening 21, which is provided on the contact support 2 and at which corresponding coding grooves 23 are arranged, as can be seen for example in FIG. 1.

In this way it is ensured that the locking element 9 can be pushed into the contact support 2 in a correct insertion position, that is to say through the clearance 22 and the opening 21 into the contact support 2, and can fix there by its locking portion 44 a contact 3 at its peripheral latching groove 33.

The locking elements 4 are preferably all formed with different coding ribs 43 and, in an equivalent manner, the openings 21 or else the clearances 22, or in a general manner the contact supports 2, are formed with corresponding coding grooves 23.

As already described, the contact support has abutting means 24, on which the contact 3 pushed into the contact chamber 5 is supported or bears with its contact abutting means 50.

The locking element 4 shown in FIG. 4 is advantageously formed with a semicircular clearance 91, the radius of the semicircular clearance 41 being made to match the radius of the peripheral latching groove 33 of a contact, and thus being able to embrace the contact semicircularly in a positively engaging manner.

It can be seen from FIG. 2 that the locking element 4, as represented in FIG. 4, is provided with a semicircular head portion 45, which is adapted to the radius of curvature of the contact support 2.

This allows the locking element 4 to be pushed flush into the contact support 2 or into the opening 21 and the clearances 22 formed in a way corresponding to the head portion 45. This in turn ensures further redundancy and reliability that the plug connector can only be inserted into the corresponding mating connector in its intended form of assembly.

In a particularly preferred embodiment, the contacts 3 are formed as contacts that are sealed off with respect to the exterior, which is ensured by a peripheral sealing groove 34, in which a sealing ring 35 is integrally formed. The sealing ring 35 abuts the inner side of the contact chamber 5 in a sealing manner, and so the connecting portion 31 of the contact and the portion of the contact chamber 5 receiving said connecting portion is sealed off with respect to the exterior.

In this way, the plug connector according to the invention can be formed as a sealed plug connector without complex sealing measures.

The contact portion 30 of a contact 3 is preferably enclosed by a contact support portion 25 protruding from the contact support 2 and thereby spatially separates the contacts 3 from one another, in that a wall of the contact support 2 is respectively formed between the contact portions 30 in order to form the air gaps and creepage distances in a suitable way in keeping with their use.

Combinations and alternative embodiments of the elements described above of the plug connector 1 according to the invention are likewise considered to be likewise disclosed. The same applies to developments familiar to a person skilled in the art that arise from features of the drawings.

LIST OF DESIGNATIONS

Plug Connector with Contact Latching Means

1 plug connector
2 contact support
3 contacts
4 locking element
5 contact chamber
20 contact chamber outer wall
21 openings
22 clearances
23 coding groove
24 abutting means
25 contact support portion
30 contacting portion
31 connecting portion
32 holding portion
33 peripheral latching groove
34 peripheral sealing groove
35 sealing ring
40 plate-like portion
41 semicircular clearance
42 plug-side end
43 coding rib
44 locking portion
45 head portion
50 contact abutting means

The invention claimed is:

1. A plug connector comprising:

A) a contact support with at least one or more contact chambers for receiving a contact;

B) at least one electrical contact;

C) a lateral opening on each side in the contact support, connected in each case with one of the contact chambers; and D) a plurality of locking elements, each of said locking elements can be introduced into one of the openings in a locking manner in such a way that a locking portion of each of said locking elements arrests or blocks the contact in the contact chamber, respectively, at a corresponding locking portion, wherein each of the locking elements has a coding member extending therefrom for engaging the contact support;

wherein the locking portion is formed at the plug-side end of the locking elements; and wherein the plug-side end is formed as a locking portion with a semicircular clearance.

2. The plug connector as claimed in claim 1, wherein the openings are formed in lateral clearances in the contact support.

3. The plug connector as claimed in claim 1, wherein the openings are formed as substantially flat slits in the contact support, and the flat slits represent a preferably lateral connection between the contact chamber and the outside.

4. The plug connector as claimed in claim 1, wherein each locking element is of such a form that it can be inserted into the contact support through a clearance and the opening in such a way that it finishes flush with the outer wall of the plug connector and thereby arrests the contact in the contact chamber with its locking portion.

5. The plug connector as claimed in claim 1, wherein the coding member of each of the locking elements is a coding rib.

6. The plug connector as claimed in claim 5, wherein the clearances and/or openings are formed with a coding groove corresponding to the locking element.

7. The plug connector as claimed in claim 1, wherein the contacts have a peripheral latching groove for the engagement of the locking portion of the locking elements.

8. The plug connector as claimed in claim 7, wherein, with the contacts respectively fitted in the contact chamber, the position of each latching groove of each contact is arranged in relation to its neighboring opening in such a way that the locking element engages with its locking portion in the latching groove if the corresponding locking element has been pushed completely into the equivalent opening.

9. The plug connector as claimed in claim 8, wherein the position of the latching groove of a fitted contact is positioned in the extension of the opening in the contact chamber.

10. The plug connector as claimed in claim 1, wherein the contacts have a peripheral sealing groove with a sealing ring, which, with the contacts fitted, seals off the contact chamber with respect to the plugging face of the plug connector.

11. The plug connector as claimed in claim 1, wherein the locking elements are of such a form that they finish flush with the contact support outer side, as long as the locking elements have been pushed completely into the contact support or the openings in the intended way.

12. The plug connector as claimed in claim 1, wherein the locking element fixes the contact axially in or counter to the plugging direction of the plug connector.

13. The plug connector as claimed in claim 1, wherein the locking element fixes the contact radially in or counter to the plugging direction of the plug connector.

14. A plug connector comprising:

A) a contact support with at least one or more contact chambers for receiving a contact;

B) at least one electrical contact;

C) a lateral opening on each side in the contact support, connected in each case with one of the contact chambers; and D) a plurality of locking elements, each of said locking elements adapted to be introduced into one of the openings in a locking manner in such a way that a locking portion of each of said locking elements arrests or blocks the contact in the contact chamber, respectively, at a corresponding locking portion, wherein each of the locking elements has a coding member extending therefrom for engaging the contact support, and said coding members are different from one another;

wherein the locking portion is formed at the plug-side end of the locking elements; and wherein the plug-side end is formed as a locking portion with a semicircular clearance.

15. A plug connector as claimed in claim 14, wherein the coding members are different coding ribs.

16. A plug connector as claimed in claim 14, wherein the contact support includes a plurality of coding members each at the lateral openings, respectively, the coding members of the contact support corresponding to the coding members of the locking elements.

17. A plug connector as claimed in claim 16, wherein the coding members of the contact support are coding grooves.

* * * * *